US005267606A

United States Patent [19]

Cassia

[11] Patent Number: 5,267,606

[45] Date of Patent: Dec. 7, 1993

[54] VEHICULAR FLUSHING AND DRAINING APPARATUS AND METHOD

[76] Inventor: Roland Cassia, 12 Allan Dr., White Plains, N.Y. 10605

[21] Appl. No.: 790,423

[22] Filed: Nov. 12, 1991

Related U.S. Application Data

[63] Continuation-in-part of Ser. No. 726,382, Jul. 5, 1991, Pat. No. 5,097,894.

[51] Int. Cl.[5] ..... F28G 9/00

[52] U.S. Cl. ..... 165/71; 165/95; 134/169 A; 141/59

[58] Field of Search ..... 165/71, 95; 134/169 A; 141/59

[56] References Cited

U.S. PATENT DOCUMENTS

| | | | |
|---|---|---|---|
| 2,188,245 | 12/1938 | Middleton . | |
| 3,653,430 | 4/1972 | Kinast | 165/71 |
| 4,127,160 | 11/1978 | Joffe | 165/95 |
| 4,149,574 | 4/1979 | Lehmann et al. | 165/71 |
| 4,763,724 | 8/1988 | Temmesfeld et al. | 165/71 |
| 4,791,890 | 12/1988 | Miles et al. | 165/95 |
| 4,793,403 | 12/1988 | Vataru et al. | 165/95 |
| 4,911,211 | 3/1990 | Anderson | 123/41.14 |
| 4,949,765 | 8/1990 | Creeron | 134/169 A |
| 5,097,894 | 3/1992 | Cassia | 165/71 |

*Primary Examiner*—Albert W. Davis, Jr.
*Attorney, Agent, or Firm*—Lucas & Just

[57] ABSTRACT

The apparatus and method for flushing and draining the cooling system of a vehicle employs a drain pipe. The drain pipe connects to the bottom of the radiator, the bottom of the engine block or the lower radiator hose and has a bend of 180° above both the inlet and outlet of the drain pipe. The outlet of the drain pipe is below the inlet for the drain pipe.

11 Claims, 7 Drawing Sheets

VEHICULAR FLUSHING AND DRAINING APPARATUS AND METHOD

This is a continuation-in-part of U.S. patent application Ser. No. 726,382 filed Jul. 5, 1991, now U.S. Pat. No. 5,097,894 granted Mar. 24, 1992.

This invention relates to an apparatus and method for flushing and draining a cooling system of a motor and specifically the cooling system of an internal combustion engine of a vehicle.

Corrosion materials such as rust and solder corrosion residue are formed in the cooling systems of vehicles as the corrosion inhibitors in antifreeze break down from heat over time. These corrosion materials reduce the efficiency of the cooling system. Additionally, the abrasive nature of the suspended corrosive materials increases the wear on the radiator, water pump, hoses, thermostat, and heater core. Malfunction of cooling system components is one of the most common causes of vehicle breakdowns on the highway.

Most vehicle manufacturers recommend changing the coolant every year. To properly change the coolant in a vehicle's cooling system, it is necessary to flush and drain the radiator, the engine block, the heater core and the connecting hoses. Flushing and draining of only the radiator does not flush or drain the coolant from the engine block, heater and the connecting hoses. Conventionally, in order to flush the cooling system of a motor, the motor was started and run for a period of time in order to open up the thermostat. Then flushing fluid was introduced through the radiator and removed through the radiator once it had circulated through the system.

There are presently several different approaches an individual vehicle owner or a mechanic can follow to flush and drain old coolant from the entire cooling system. All have their drawbacks.

Because of the limitations of the known methods for draining and flushing the cooling system of their vehicle, many car owners do not replace used coolant. This leads to a large number of vehicles not being serviced as they should be which results in undue wear and tear on the cooling system and premature breakdown. There is a need for a simplified way to properly flush the cooling system and recharge it with fresh coolant, without the need for substantial mechanical expertise and physical labor.

The present invention is an improved fluid cooling system for an engine of a vehicle or other machinery that provides for an easy and efficient means to flush and/or drain the cooling system of the engine. The improvement comprises a drain pipe having an inlet in fluid communication with the circulating fluid of the cooling system, said inlet being positioned at a low point in the cooling system and said drain pipe having an outlet which is positioned at a point below the inlet of the drain pipe, said drain pipe providing a fluid channel for fluid in said cooling system to leave said cooling system, said drain pipe having a bend of about 180° therein, said bend being located above both the inlet and outlet of said drain pipe; a flushing fluid inlet in fluid communication with the circulating fluid for introduction of flushing fluid into the cooling system to allow for flushing of the system; and valve means to open and close the fluid channel in said drain pipe. In order to drain fluid from said cooling system when said valve means is open, air is allowed to enter the cooling system. The cooling fluids leave the cooling system through the drain pipe during the flushing and draining operation.

The present invention also provides a safety feature heretofore unknown in vehicular cooling systems. When a car's radiator overheats, it has been the practice to wait until the radiator cools off before removing the radiator cap and adding more cooling fluids. This means that all the valves and gaskets in the system are under a great deal of pressure during the cooling-off period. In a cooling system employing the present invention, the valve means can be opened immediately upon overheating thereby alleviating the pressure in the system and reducing the strain on the various components in the system.

The present invention can be used for cross-flow radiators, down-flow radiators, and closed radiator systems.

The fluid cooling system for vehicles and other machinery typically comprises a heat exchanger, i.e. a radiator, an engine block and an upper radiator hose for circulating fluid from the engine block to the radiator and a lower radiator hose for circulating coolant from the radiator to the engine block. Radiators are generally comprised of a core which is enclosed in a shell. The shell has an inlet and an outlet for circulating coolant. The radiator inlet is generally connected to the upper radiator hose while the outlet is connected to the lower radiator hose. All three components, radiator, engine block and lower/upper radiator hoses, are in fluid communication with each other and allow the coolant to circulate when the engine is running.

Preferably, the low point in the cooling system at which the inlet to the drain pipe is located is in the bottom of the radiator, the bottom of the engine block or the lower radiator hose.

The flushing fluid inlet is preferably located at a high point in the cooling system such as the top of the engine block, the top of the radiator or the upper hose. This high point is preferably above the fluid level or intended fluid level in the cooling system. However, it can be located in the lower radiator hose.

The preferred embodiments of the present invention are the flushing fluid inlet located in the upper radiator hose or the radiator shell and the drain pipe inlet located in the engine block; or the flushing fluid inlet located in the radiator shell and two drain pipe inlets, one located in the radiator and another located in the engine block.

Where the drain pipe inlet and flushing fluid inlet are in a cross-flow radiator, the flushing fluid inlet is positioned on the opposite side of the radiator shell from the drain pipe. Where the drain pipe inlet and flushing fluid inlet are in a down-flow radiator, the flushing fluid inlet can be on either side of the radiator shell.

Preferably, where the flushing fluid inlet is in the radiator, a flushing fluid inlet pipe is connected to the flushing fluid inlet and positioned in said radiator shell so as to distribute flushing fluid from said flushing fluid inlet across the radiator core. Preferably, the flushing fluid inlet pipe is perforated to distribute flushing fluid uniformly throughout the core in a down-flow radiator.

The bend in the drain pipe is located above both the inlet and the outlet of the drain pipe. The bend is located either below, at, or above the fluid level in the cooling system. Preferably, the bend is located at or below the fluid level in the cooling system. The fluid level in the cooling system is the level of the coolant at the highest point in the cooling system. This point is generally the coolant level in the radiator. When the bend in the drain pipe is located below the fluid level in the cooling system, it is located about 1 to about 2 inches below the fluid level or intended fluid level in the radiator. The drain pipe employs a single 180° bend.

It is also preferred that the valve means be positioned in said drain pipe at the bend in said drain pipe so as to provide easy access to open and close the valve means. Where the drain pipe inlet is in the radiator, the bend in the drain pipe is preferably located at the top of the radiator shell. The valve means can be a small electric pump.

In order to drain the coolant from the fluid cooling system of the present invention, the valve means is opened to allow the coolant fluid to flow out of the system and air is introduced into the system to allow the fluid to continue to flow. Because the outlet of the drain pipe is positioned below the inlet to the drain pipe, the cooling fluid in the system will flow out of the system once the fluid starts to flow through the drain pipe. In the case where the bend is at or above the fluid level in the system, the fluid in the cooling system must be under pressure to start to flow out the drain pipe. The pressure can come from the fact that the cooling fluid is hot or because flushing fluid is being introduced into the system. Once the fluid starts to drain from the cooling system, it will continue to drain without the need for additional pressure. Where the bend is below the fluid level in the system, the fluid in the system provides the pressure in the system to force the fluid to start to flow.

Air is introduced to the system during the draining process by means of the overflow cap or the vent lever on the overflow cap. This overflow cap is sometimes referred to as the radiator cap. Alternatively, the flushing fluid inlet can be opened.

In order to flush the entire cooling system, the engine must be running and up to temperature in order to open all internal valves in the cooling system and to circulate the cooling fluid through the cooling system, except that the system can be flushed cold where the flushing fluid inlet is located in the radiator or top radiator hose and the drain pipe inlet is located in the engine block. In the case where the engine is running and all the valves are opened, flushing fluid is circulated into the system through the flushing fluid inlet and the valve means is opened to allow the flushing fluid and old coolant to leave the system. When the flushing fluid inlet is located in the upper radiator hose (after the thermostat) or in the radiator and the drain pipe inlet is located in the engine block, the majority of the coolant in the cooling system is drained and flushed by merely employing the flushing fluid inlet and the drain pipe without having to run the engine. Naturally, such a cold drain is dependent upon the location of the valves in the cooling system.

In order to flush just the radiator where the drain pipe inlet is located in the radiator and the flushing fluid inlet is located in the radiator, the valve means is opened and flushing fluid is introduced through the flushing fluid inlet means. The flushing fluid will pass through the core of the radiator and out of the radiator through the drain pipe. The radiator cap and the vent lever should be closed during flushing.

Where the drain pipe inlet is located in a low point in the engine block, the engine block can be drained by opening the valve means and allowing air to enter cooling fluid channels in the engine block.

To flush the engine block where the flushing fluid inlet and the drain pipe inlet are in the engine block, the valve means is opened to the drain pipe and flushing fluid is passed into the engine block.

As will be evident from the below discussion of the present invention, pre-existing cooling systems can be modified to conform to the present invention.

In a radiator, the drain pipe can be positioned either inside the shell, outside the shell, or with one half inside the shell and the other half outside the shell. In a radiator, the inlet of the drain pipe must be positioned at the bottom of the radiator so as to pick up the flushing fluid after it has passed through the core. Preferably, the inlet to the drain pipe is positioned about 0.5 to 2 inches from the bottom of the radiator shell. No matter where the drain pipe inlet is positioned, the outlet end of the drain pipe must be positioned below the inlet end of the drain pipe.

These and other aspects of the present invention may be more fully understood by reference to the following drawings wherein.

Figure 1:
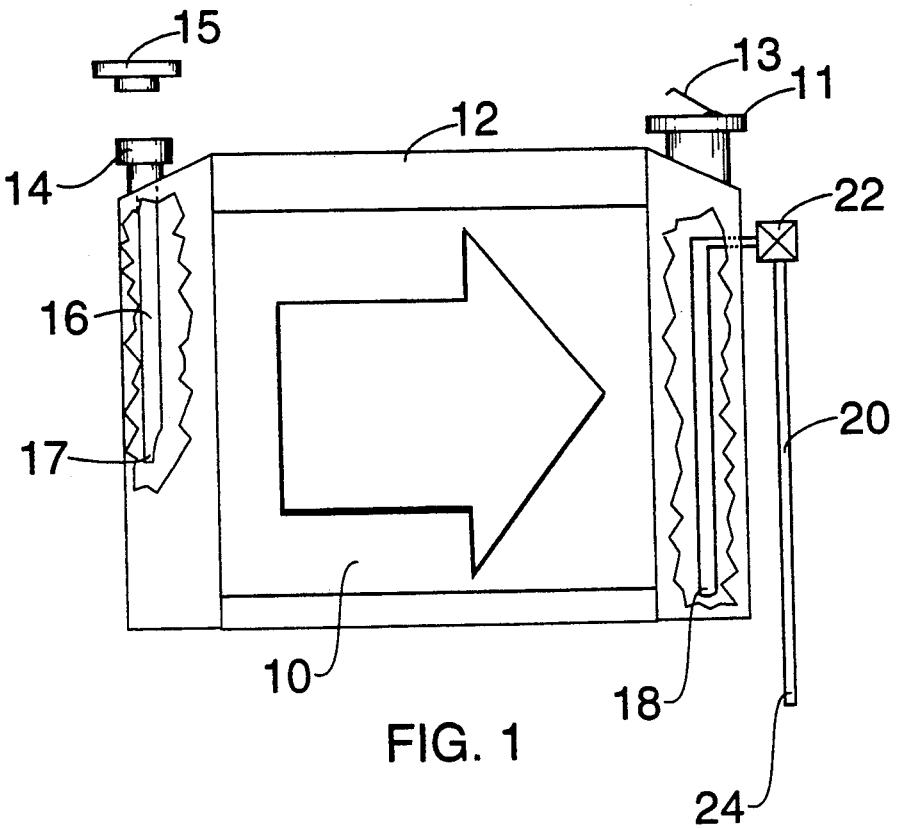
FIG. 1 illustrates a cross-flow radiator modified in accordance with the present invention.

FIG. 1 illustrates a cross-flow radiator made up of core 10 which is surrounded by shell 12. Cap 11 with vent lever 13 is for radiator shell 12. In shell 12 at the upper lefthand corner is positioned flushing fluid inlet 14. Cap 15 is for flushing fluid inlet 14. Connected to flushing fluid inlet 14 is flushing fluid inlet pipe 16 which is restricted at end 17. Flushing fluid inlet 14 and pipe 16 allow flushing fluid to be introduced into the radiator shell through flushing fluid inlet 14 and out through pipe 16. The flushing fluid then passes through core 10 as illustrated by the arrow in FIG. 1. When flushing fluid leaves core 10, it travels down by the force of gravity to inlet 18 of drain pipe 20. The flushing fluid then passes through valve 22. After leaving valve 22, the flushing fluid passes down through drain pipe 20 and outlet 24. As illustrated in FIG. 1, outlet 24 of drain pipe 20 is below inlet 18 of drain pipe 20. In a cross-flow radiator, it is important that the flushing fluid inlet is on the opposite side of the radiator from the drain pipe inlet. The 180° bend in drain pipe 20 is below the fluid level or intended fluid level in the cross-flow radiator of FIG. 1.

Figure 2:
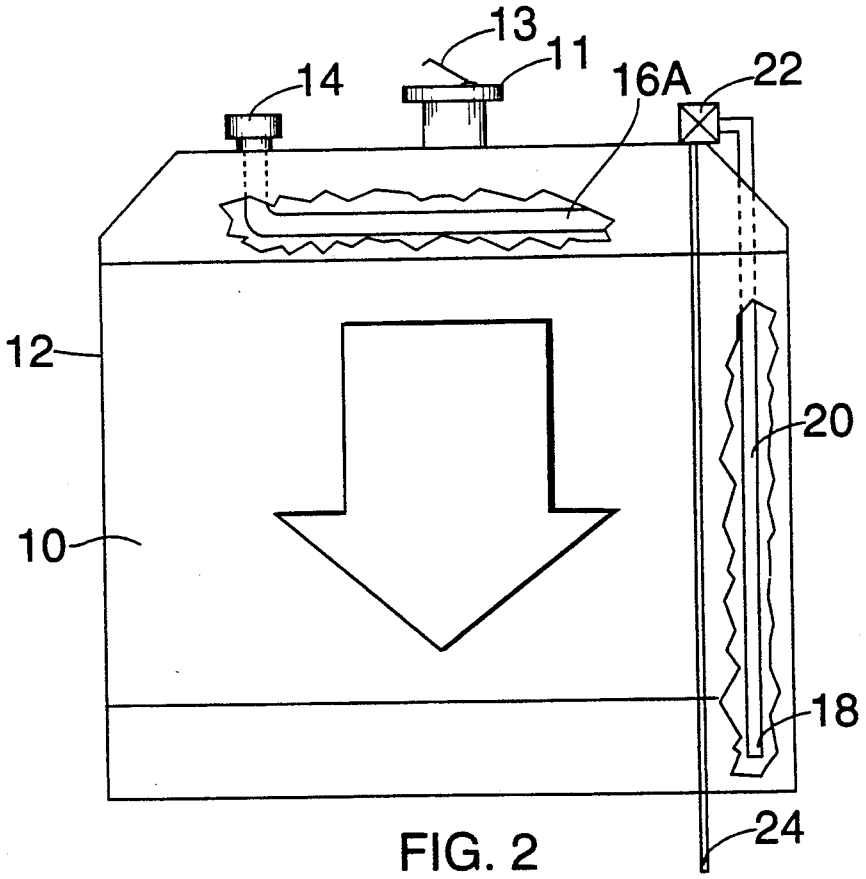
FIG. 2 illustrates a down-flow radiator modified in accordance with the present invention.

FIG. 2 illustrates a radiator modified in accordance with the present invention for a down-flow radiator. In the case of the down-flow radiator as illustrated in FIG. 2, radiator core 10 is surrounded by radiator shell 12. Flushing fluid is introduced through flushing fluid inlet 14 and passes through perforated pipe 16A to introduce flushing fluid across the core. The flushing fluid then passes through the core as illustrated by the arrow in FIG. 2. The flushing fluid once passing through core 10 passes to inlet 18 of drain pipe 20. Flushing fluid then passes up through drain pipe 20 and into valve 22. The flushing fluid after passing through valve 22 then passes down through drain pipe 20 and out through outlet 24 of drain pipe 20. As is illustrated in FIG. 2, outlet 24 of drain pipe 20 is below inlet 18 to drain pipe 20. In a down-flow radiator the drain pipe can be connected on either side of the radiator. Both the 180° bend in drain pipe 20 and valve 22 are located above the fluid level of the radiator.

Figure 3:
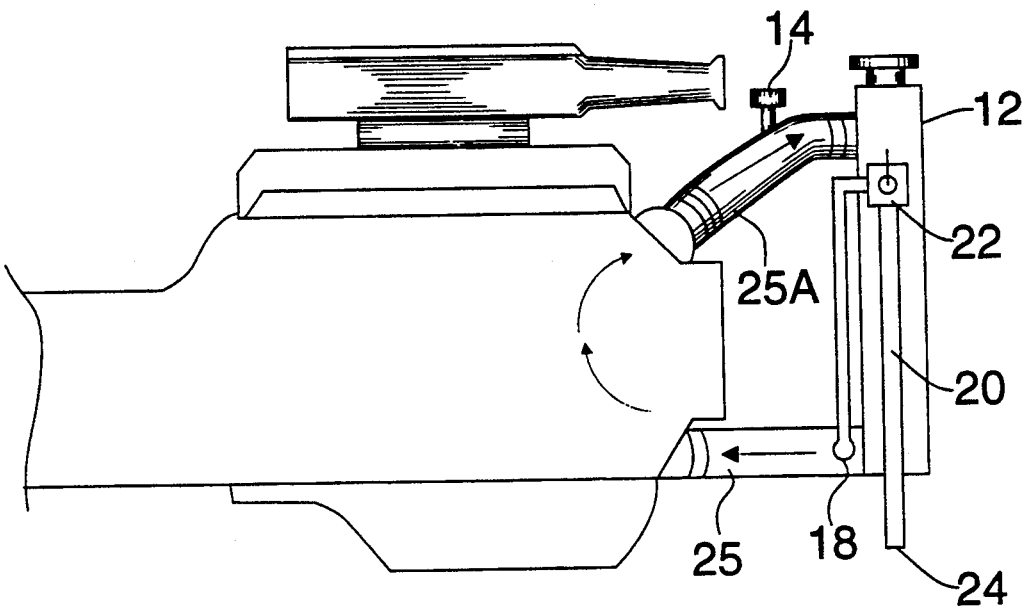
FIG. 3 illustrates the present invention wherein the drain pipe inlet is connected to the lower radiator hose and the flushing fluid inlet is connected to the upper radiator hose.

FIG. 3 illustrates an alternative embodiment to the present invention wherein drain pipe 20 is positioned on the outside of radiator shell 12 and inlet 18 of drain pipe 20 is connected to radiator exit pipe 25. Specifically, radiator shell 12 has a cooling fluid outlet positioned at the bottom corner of shell 12. The radiator shell cooling fluid outlet is connected to radiator exit pipe 25. Radiator exit pipe 25 provides cooling fluid to the engine block. Drain pipe 20 is positioned along the side of shell 12 and is connected at inlet end 18 to radiator exit pipe 25. Outlet 24 of drain pipe 20 is below inlet 18 of drain pipe 20. Flushing fluid inlet 14 is positioned in upper radiator hose 25A.

As can be seen in FIGS. 1-3, valve 22 is located in the 180° bend in drain pipe 20. In FIGS. 1 and 3 the bend is located below the normal fluid level in radiator shell 12 while in FIG. 2 the bend is located above the fluid level of the radiator shell.

In one application of the present invention as depicted in FIGS. 1 and 3, the radiator of the vehicle is drained by merely opening the valve 22 which, due to the fact that the fluid normally contained within the radiator is under pressure, causes the fluid in the radiator to flow out of the radiator by means of the drain pipe. Valve means 22 can also be a small electric pump for withdrawing fluid from the vehicle's cooling system. The pump can be run off of the vehicle's electrical system or an external electrical system.

Figure 4:
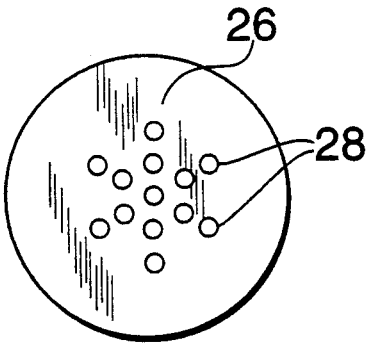
FIG. 4 illustrates a disk which is used in the flushing fluid inlet in order to increase the fluid pressure of the flushing fluid.
Figure 5:
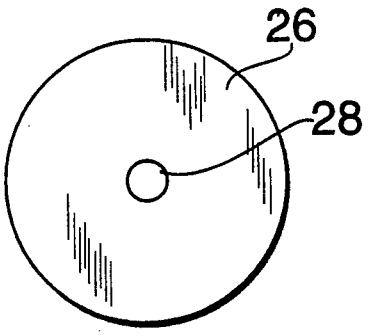
FIG. 5 illustrates another embodiment of the disk used in the flushing fluid inlet.

Preferably, flushing fluid inlet 14 has a disk 26 therein as shown in FIGS. 4 and 5. Disk 26 is adapted so that flushing fluid is passed under pressure into the system through inlet 14. Disk 26 is adapted to decrease the surface area of flow of the flushing fluid and therefore increase the rate of flow. Suitable adaptations to disk 26 include a decrease in size of the aperture for transmission of flushing fluid therethrough, or use of a plurality of smaller apertures instead of one larger aperture. Different variations of the apertures of disk 26 are shown in FIGS. 4 and 5. FIG. 5 shows disk 26 having aperture 28 which is smaller in surface area than the end of the garden hose. FIG. 4 shows disk 26 having a plurality of smaller apertures 28, the total surface area of apertures 28 being less than the surface area of the end of the garden hose. It is preferred that the total surface area of apertures 28 be less than about 75% of the surface area of disk 26. It is more preferred that the surface area of apertures 28 be less than about 60% of the surface area of disk 26, and it is most preferred that the surface area of apertures 28 be less than about 50% of the surface area of disk 26. Good results have been found where the apertures measure about 1/6 inch to about 3/16 inch in diameter. It will be evident to one of skill in the art that both the temperature and volume of flushing fluid that enters the cooling system must be such that the temperature of the fluid in the cooling system is hot enough to maintain the thermostat in an open position during flushing in order to flush the entire cooling system during a hot flush.

The flushing fluid can be a conventional flushing fluid used for vehicle cooling systems to include water from a garden hose. Either the flushing fluid inlet or the radiator shell inlet covered by cap 11 can be used to add new cooling fluid once flushing and/or draining is complete.

Figure 6:
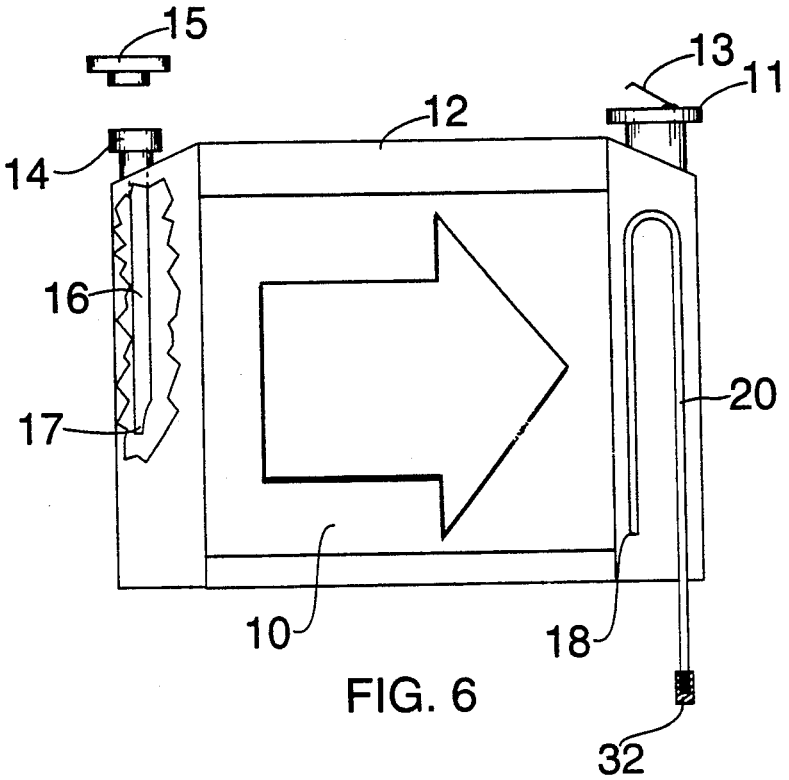
FIG. 6 illustrates the present invention wherein the valve means of the drain pipe is located on the outlet end of the drain pipe.

FIG. 6 illustrates a radiator wherein the valve is cap 32 at the end of drain pipe 20. Cap 32 connects to drain pipe 20 by conventional means such as a threaded screw. Drain pipe 20 can be made from a flexible pipe for easy handling.

Figure 7:
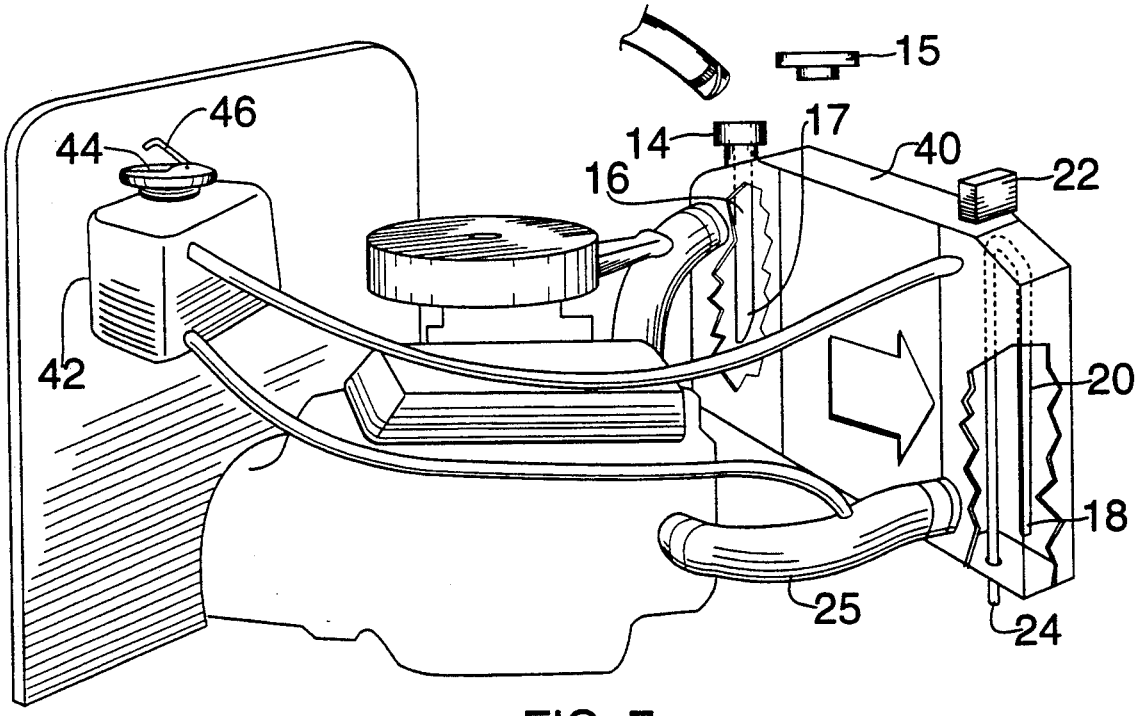
FIG. 7 illustrates a closed radiator system wherein the drain pipe is positioned on the inside of the radiator shell.

FIG. 7 illustrates the present invention in a closed radiator system. Radiator 40 is equipped with overflow tank 42 with cap 44. Cap 44 is equipped with vent lever 46. Radiator 40 is equipped with drain pipe 20 and flushing fluid inlet 14. Drain pipe 20 is fully enclosed in radiator 40. Valve 22 is located above the fluid level in the radiator, while the bend in drain pipe 20 is located at or above the fluid level in the radiator.

Figure 8:
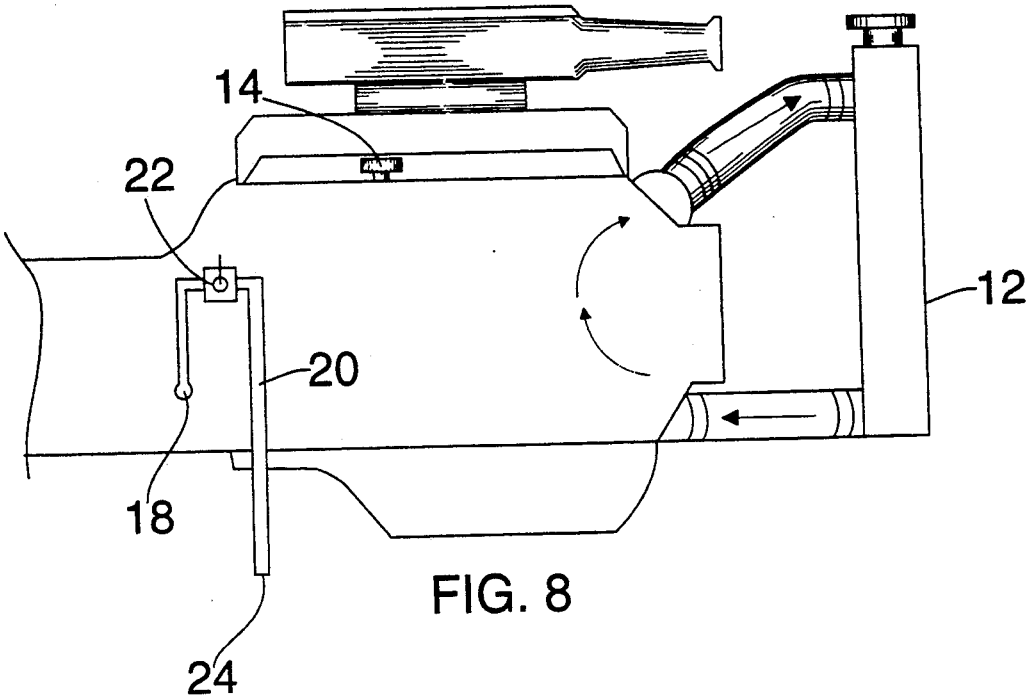
FIG. 8 illustrates the present invention wherein the drain pipe inlet and the flushing fluid inlet are in the engine block.

FIG. 8 illustrates the present invention wherein drain pipe inlet 18 is positioned in the lower half of the engine block and flushing fluid inlet 14 is positioned in the top half of the engine block. In this embodiment, inlet 18 is preferably connected to the cooling system through a drain plug in the engine block. In the embodiment shown in FIG. 8 the bend can be either above or below the fluid level in the engine block. If the bend is below the fluid level in the engine block, then the cooling system will flow out of the engine block once valve 22 is opened. If the bend is above the fluid level in the engine block, then the cooling fluid must be under pressure to flow out drain pipe 20.

Drain pipe 20 can be positioned anywhere in the cooling system so long as inlet 18 is positioned at a low point in the cooling system such as at the bottom of the engine block, the bottom of the radiator shell or in one of the lower hoses.

Figure 9:
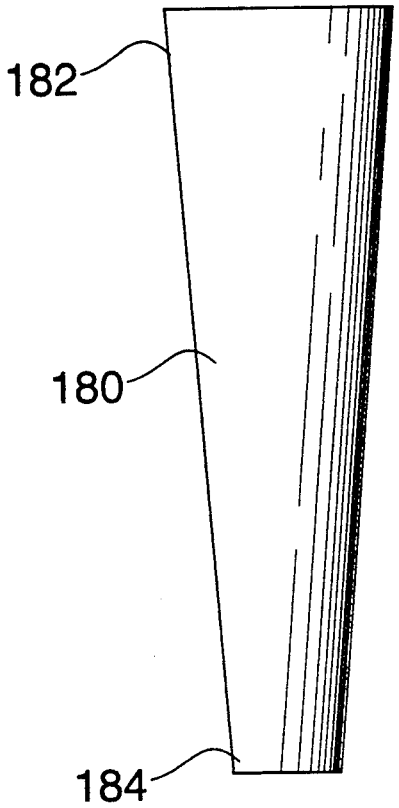
FIGS. 9-11 illustrate a restriction at the one end of the flushing fluid inlet pipe.

FIG. 9 illustrates a preferred embodiment of the restricted end of the flushing fluid inlet pipe for use in a cross-flow radiator. As shown in FIG. 9, flushing fluid inlet pipe 180 is attached at end 182 to the flushing fluid inlet and tapers down to restricted end 184. Preferably, the amount of tapering is such that the inside diameter at end 182 is two or more times larger than the inside diameter at end 184.

Figure 10:
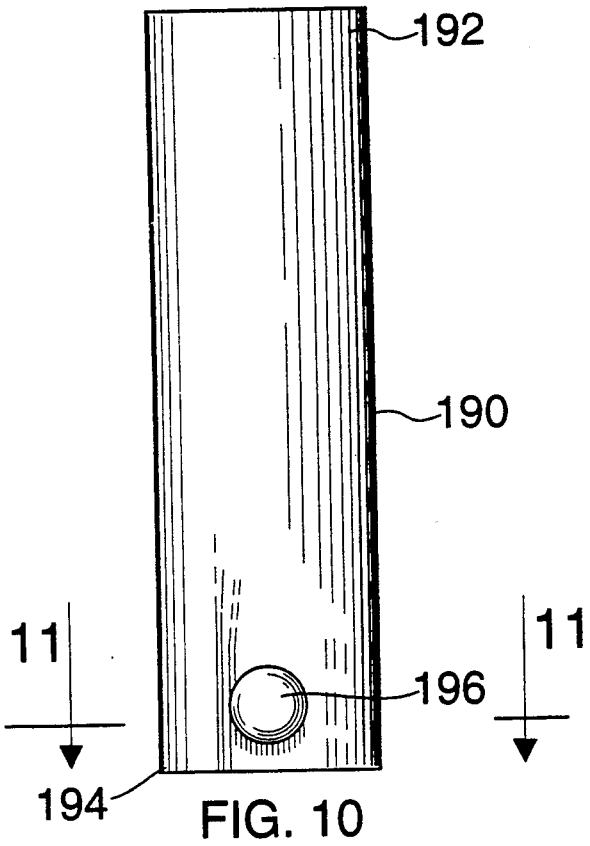

An alternative to the tapered design in FIG. 9 is to use a rivet or other means to restrict the end of the flushing fluid inlet pipe as shown in FIG. 10. Flushing fluid inlet pipe 190 attaches to the flushing fluid inlet at end 192 while end 194 with rivet 196 therein extends down into the radiator.

Figure 11:
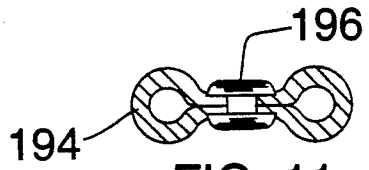

FIG. 11 shows a cross section of end 194 taken along line 11 of FIG. 10.

The embodiments in FIGS. 9 and 10 are preferred for use in a cross-flow radiator. It has been found that the restricted ends help to increase the pressure of the water exiting the tube and stir up the coolant and promote the efficiency of the flushing. Flushing fluid inlet pipe 16 with restricted end 17 can also be used in a down-flow radiator as well as a cross-flow radiator.

Figure 12:
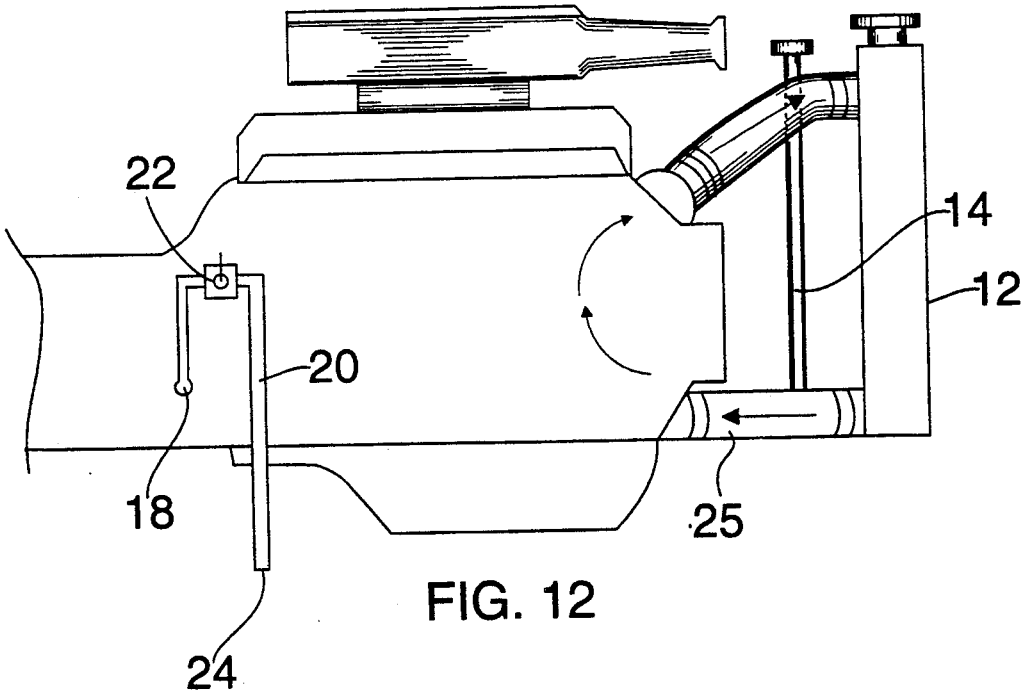
FIG. 12 illustrates the present invention wherein the drain pipe inlet is in the engine block and the flushing fluid inlet is in the lower radiator hose.

FIG. 12 illustrates the present invention wherein drain pipe 20 is positioned at the engine block and flushing fluid inlet 14 is positioned in lower radiator hose 25.

Figure 13:
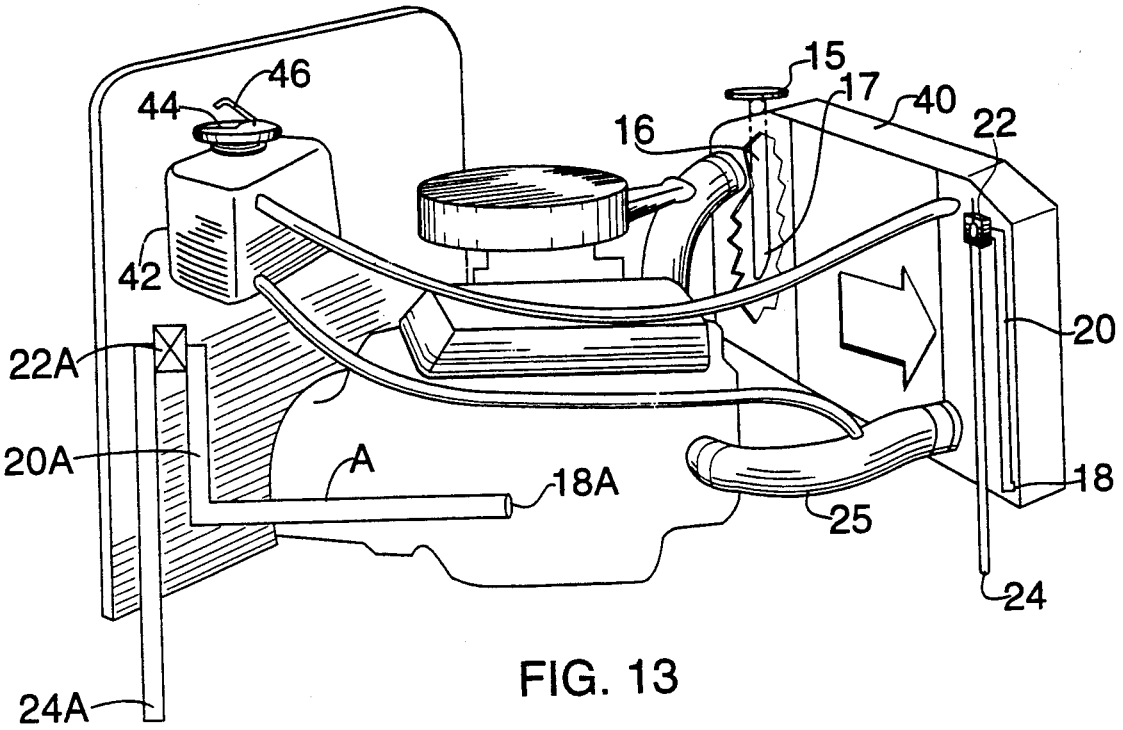
FIGS. 13 and 14 illustrate the embodiment wherein two drain pipes are employed in accordance with the present invention.

FIG. 13 illustrates where drain pipe 20A is connected to valve 22A which is affixed to the fire wall of the vehicle. Portion A of drain pipe 20A allows the fluid to travel from the drain plug of the engine block across to the fire wall before travel up to the bend. A second drain pipe 20 is connected to radiator 40. In other words, a drain pipe according to the present invention can be employed both with the radiator and with the engine block. This will allow for maximum flexibility for flushing and/or draining the cooling system of an engine.

Figure 14:
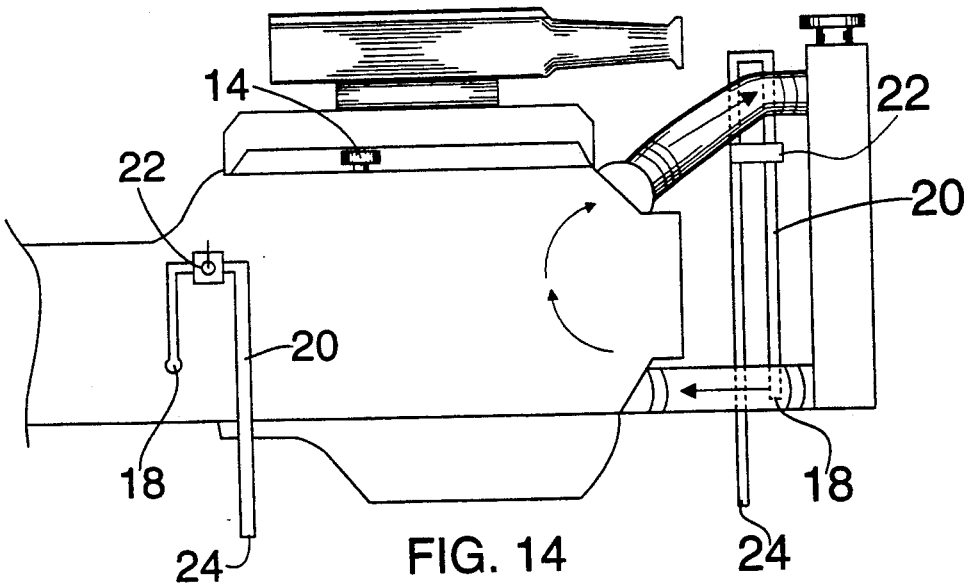

FIG. 14 illustrates the present invention wherein a drain pipe has been installed in both the engine block and the lower radiator hose. The flushing fluid inlet is in the engine block.

Figure 15:
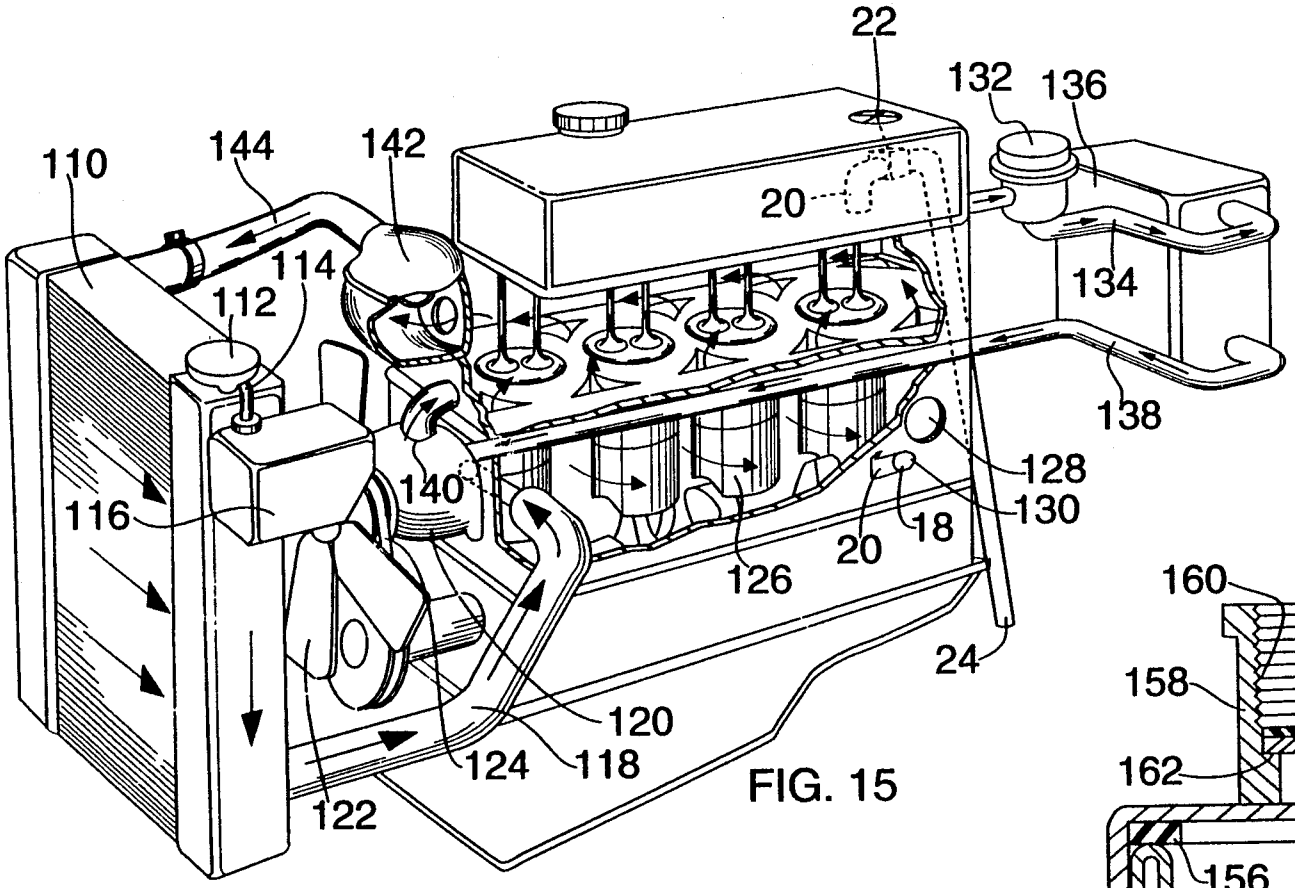
FIG. 15 illustrates the present invention wherein the flushing fluid inlet is the radiator inlet and the drain pipe is positioned in the engine block to allow for cold draining and flushing of an engine.

FIG. 15 illustrates a conventional cooling system in a vehicle, specifically a car. The arrows indicate the flow of coolant through the system. Radiator 110 has pressure cap 112 and, as depicted, is a cross-flow radiator. Overflow tube 114 is connected to coolant recovery tank 116. Lower hose 118 allows coolant to leave radiator 110 and travel to water pump 120. Fan blade 122 is rotated by engine V-belt 124. The coolant is pumped by water pump 120 into the engine and around cylinder blocks and head 126. Core plug 128 and drain plug hole 130 of the engine are shown. Some coolant from the engine travels through heater control valve 132 and heater supply hose 134 to heater 136. The coolant then leaves heater 136 through heater return hose 138 to water pump 120. Bypass hose 140 is also shown. Coolant travels from the engine into thermostat 142 and is carried by upper hose 144 to radiator 110. Drain pipe 20 is connected to the engine block through drain plug hose 130 of the engine block. Pressure cap 112 is removed and the radiator inlet is used as the flushing fluid inlet. In order to introduce the flushing fluid into the system, a cap as shown in FIG. 16 is preferably employed.

Figure 16:
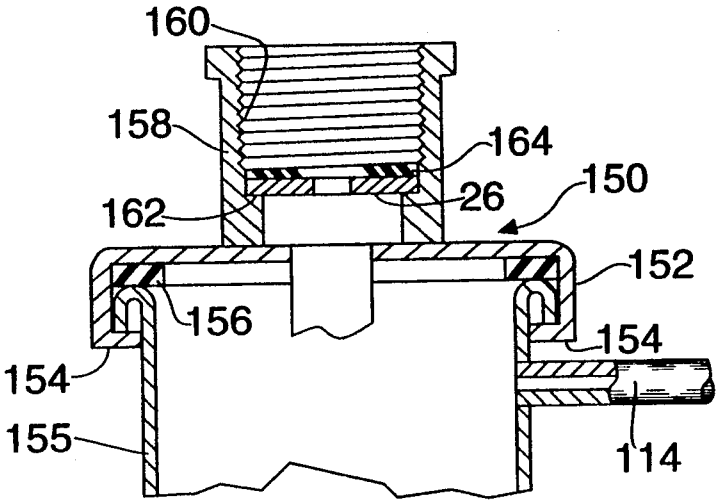
FIG. 16 illustrates a modified radiator cap or flushing fluid inlet cap for introducing flushing fluid into the system.

In FIG. 16, cap 150 has a vertical side wall or flange 152 which has two tabs 154 which are adapted to move underneath complementary tabs on the outer wall of the radiator inlet pipe or the flushing fluid inlet 155. Located on the underside of the horizontal wall of cap 150 is a gasket or rubber washer 156. This washer is pressed onto the top end of the inlet pipe and forms a watertight seal with the inlet when the cap 150 is rotated into final operating position. Cap 150, side walls 152 and tabs 154 are all integral.

Extending vertically upward from cap 150 is an inlet opening 158 having internal threads and adapted to receive a source of water such as a standard garden hose. Preferably, inlet opening 158 swivels to facilitate screwing on an off of a hose. Inlet opening 158 extends above cap 150 and includes a threaded upper portion 160 having a shoulder 162. The end of a water source such as a standard garden water hose is threaded into portion 160 with the lower end of the hose bearing upon washer 164 which rests on the shoulder 162. Preferably, inlet opening 158 has disk 26 therein. Cap 150 is preferably used on the flushing fluid inlet no matter whether the flushing fluid inlet is the radiator inlet or an inlet separate from the radiator inlet.

The present invention allows for easy addition of conventional radiator chemical cleaning additives such as Cooling System Cleanser No. 7 or Radiator 10-Minute Flush. The chemical may be added to the cooling system in order to remove corrosive elements and scale which are not suspended in the coolant fluid. The chemical additive can be added to the system, circulated through the system, and flushed from the system using the present invention.

In order to drain the fluid from the radiator, air must be let into the cooling system. Preferably, this is done by means of opening the radiator cap, the vent lever on the radiator cap, the overflow tank cap on a closed radiator system, or the vent lever on the cap of the overflow tank in the closed radiator system.

The outlet of the drain pipe can be threaded to accept a hose. Also, a pump can be connected to the drain pipe to aid in draining the radiator. The flushing fluid inlet can also be threaded to accept a garden hose as illustrated in FIG. 7.

In order to flush the radiator without the engine running using an embodiment of the present invention as shown in FIGS. 1–3, 6, 7 and 13, the following procedure is preferably employed. First, connect the water hose to the flushing fluid inlet. Then, open the valve or drain pipe. Then turn on the water supply to the flushing fluid inlet. The radiator will now flush.

In order to flush the radiator, motor block and heater core when starting with a cold motor using an embodiment of the present invention as shown in FIGS. 1–3, 6–8 and 12–15, the preferred method is to first open the valve or drain pipe. Next, open the radiator cap or vent lever to allow air into the system and let the radiator and/or engine block drain. Then close the valve on the drain pipe, remove the cap on the flushing fluid inlet and connect a water supply to the flushing fluid inlet and fill the radiator and/or engine block, turn off the water supply and close the radiator cap or vent lever to seal the cooling system. Finally, start the motor and allow it to heat to normal temperature, thereby opening all the internal valves in the cooling system. Once the motor is up to temperature, open the drain valve and turn on the water supply to the flushing fluid inlet. Keep the motor running to circulate the old coolant and keep the thermostat open for circulation. Now you are flushing the motor block, radiator and heater core. The flushing is continued until water is clear.

As is the case with the embodiment in FIG. 15, cap 150 is used on radiator inlet 155 to introduce flushing fluid into the system. In that case, the flushing fluid inlet and the radiator inlet are one and the same.

In order to drain and/or flush the engine block and the radiator while the engine is still cold, one of the embodiments of the present invention shown in FIGS. 8 and 12–15 is used. First, drain pipe 20 is used to drain the engine block and radiator. Then, in the case of flushing, flushing fluid is introduced in the radiator using cap 150. The flushing fluid will then pass through the radiator, into the engine block and out through the drain pipe 20. In the embodiment shown in FIGS. 13 and 14, the drain pipe nearest the radiator, i.e. in the radiator in FIG. 13 or in the lower radiator pipe in FIG. 14, is closed to force the flushing fluid to flow through the radiator and into the engine block. Running the engine to make pump 120 run helps move the flushing fluid when flushing and helps move the old coolant when draining; however, it is not necessary for the cold flushing/draining.

The advantage to a cold flush as described above is that the engine need not be run for a long period of time in order to open up the thermostat. This provides a time savings, especially on large trucks.

It will be understood that the claims are intended to cover all changes and modifications of the preferred embodiments of the invention herein chosen for the purpose of illustration which do not constitute a departure from the spirit and scope of the invention.

What is claimed is:

1. In a cooling system for a motor having a radiator, an engine block and cooling fluid which circulates between said radiator and engine block by means of an upper radiator hose and a lower radiator hose, the improvement comprising:

a drain pipe having an inlet in communication with the cooling fluid and located at a low point in the cooling system, and an outlet which is positioned lower than the inlet of the drain pipe, said drain pipe having a bend of about 180° therein, said bend being positioned above both said inlet and said outlet of said drain pipe;

a flushing fluid inlet which is separate and distinct from said drain pipe, said flushing fluid inlet being in fluid communication with said cooling system for introduction of flushing fluid into the cooling system; and a valve means connected to said drain pipe such that when said valve means is opened fluid flow out of said cooling system through said drain pipe, said value being located in the bend in said drain pipe.

2. The cooling system of claim 1 wherein the inlet for the drain pipe is located about ½ to about 2 inches above the bottom of the radiator.

3. In a cooling system for a motor having a radiator, an engine block and cooling fluid which circulates between said radiator and engine block by means of an upper radiator hose and a lower radiator hose, the improvement comprising:

a drain pipe having an inlet in communication with the cooling fluid and located at a low point in the cooling system, and an outlet which is positioned lower than the inlet of the drain pipe, said drain pipe having a bend of about 180° therein, said bend being positioned above both said inlet and said outlet of said drain pipe;

a flushing fluid inlet which is separate and distinct from said drain pipe, said flushing fluid inlet being in fluid communication with said cooling system for introduction of flushing fluid into the cooling system, said flushing fluid inlet being located in the radiator and a flushing fluid tube being connected at one end to the flushing fluid inlet, said flushing fluid tube being restricted at the other end; and a valve means connected to said drain pipe such that when said valve means is opened fluid flow out of said cooling system through said drain pipe.

4. In a radiator having a core and a shell and cooling fluid in said radiator, the improvement comprising:

a drain pipe having an inlet in communication with the cooling fluid and located at the bottom of the radiator shell, and an outlet which is positioned lower than the inlet of the drain pipe, said drain pipe having a bend of about 180° therein, said bend being positioned above both said inlet and said outlet of said drain pipe;

a flushing fluid inlet which is separate and distinct from said drain pipe, said flushing fluid inlet being connected to the shell for introduction of flushing fluid into the shell; and a valve means connected to said drain pipe such that when said valve means is opened fluid flows out of said radiator shell through said drain pipe, said valve means being located in the bend in said drain pipe.

5. The radiator of claim 4 wherein the inlet for the drain pipe is located about ½ to about 2 inches above the bottom of the radiator shell.

6. The radiator of claim 4 wherein the radiator is a cross-flow radiator.

7. The radiator of claim 4 wherein the radiator is part of a closed radiator system.

8. In a radiator having a core and a shell and cooling fluid in said radiator, the improvement comprising:

a drain pipe having an inlet in communication with the cooling fluid and located at the bottom of the radiator shell, and an outlet which is positioned lower than the inlet of the drain pipe, said drain pipe having a bend of about 180° therein, said bend being positioned above both said inlet and said outlet of said drain pipe;

a flushing fluid inlet which is separate and distinct from said drain pipe, said flushing fluid inlet being connected to the shell for introduction of flushing fluid into the shell, a flushing fluid tube being connected at one end to the flushing fluid inlet, said flushing fluid tube being restricted at the other end; and a valve means connected to said drain pipe such that when said valve means is opened fluid flows out of said radiator shell through said drain pipe.

9. In a cooling system for a motor having a radiator, an engine block and cooling fluid in said system, the improvement comprising:

a drain pipe having an inlet in communication with the cooling fluid and located at a low point in the engine block, and an outlet which is positioned lower than the inlet of the drain pipe, said drain pipe having a bend of about 180° therein, said bend being positioned above both said inlet and said outlet of said drain pipe;

a flushing fluid inlet which is separate and distinct from said drain pipe, said flushing fluid inlet being connected to the cooling system for introduction of flushing fluid into the cooling system; and a valve means connected to said drain pipe such that when said valve means is opened fluid flows out of said engine block through said drain pipe, said valve means being located in the bend of the drain pipe.

10. In a cooling system for a motor having a radiator, an engine block and cooling fluid which circulates between said radiator and engine block by means of an upper radiator hose and a lower radiator hose, the improvement comprising:

a drain pipe having an inlet in communication with the cooling fluid and located at the bottom of the engine block, and an outlet which is positioned lower than the inlet of the drain pipe, said drain pipe having a bend of about 180° therein, said bend being positioned above both said inlet and said outlet of said drain pipe;

a flushing fluid inlet which is separate and distinct from said drain pipe, said flushing fluid inlet being in fluid communication with said cooling system for introduction of flushing fluid into the cooling system, said flushing fluid inlet located in said radiator; and a valve means connected to said drain pipe such that when said valve means is opened fluid flows out of said cooling system through said drain pipe, said valve means being located in the bend of the drain pipe.

11. The cooling system of claim 10 wherein the flushing fluid inlet is the inlet to the radiator.

* * * * *